United States Patent [19]

Ho

[11] Patent Number: 4,991,268

[45] Date of Patent: Feb. 12, 1991

[54] MEMO CLIP

[76] Inventor: Ming-Chuan Ho, No. 83, Lane 43, Ming Chuan Rd., Kuei Jen Hsiang, Tainan Hsien, Taiwan

[21] Appl. No.: 530,321

[22] Filed: May 30, 1990

[51] Int. Cl.[5] ..... B42F 1/00

[52] U.S. Cl. ..... 24/67.3; 24/67 R; 24/67.5

[58] Field of Search ..... 24/67.3, 67.5, 67.1, 24/67 R, 499, 498, 518

[56] References Cited

U.S. PATENT DOCUMENTS

| | | | |
|---|---|---|---|
| 2,566,465 | 9/1951 | Robbins | 24/67.5 |
| 3,168,954 | 2/1965 | Von Herrmann | 24/67 R |
| 3,364,528 | 1/1968 | Fletcher | 24/67.1 |
| 4,147,257 | 4/1979 | Bippel | 24/67.1 |
| 4,864,699 | 9/1989 | Whitcomb | 24/67.5 |

*Primary Examiner*—Victor N. Sakran

*Attorney, Agent, or Firm*—Morton J. Rosenberg; David I. Klein

[57] ABSTRACT

An improved memo clip and in particular to one utilizing a saw teeth plate and a pressing plate to clip paper and grasp the paper firmly by means of a spring. When desired to pull one piece of paper out, it is simply by pulling the piece of paper out either from left or right hand side and paper will easily be pulled out without bothering other paper.

2 Claims, 5 Drawing Sheets

MEMO CLIP

PRIOR ART OF THE INVENTION

The prior art of memo clip is using a steel ball rolling in a concave of a main body up and down so as to press paper against a flat surface of a back body. The force of the steel ball pushes paper against the back wall is too strong to draw paper and sometimes when desire to draw a piece of paper out but the whole paper will come out.

BACKGROUND OF THE INVENTION

The inventor, in view of this, has invented this improved memo clip which is capable of accepting more paper and is able to be drawn one piece of paper and leave the rest paper stay steadly in position and can be made as an indoor ornament without losses its original function.

SUMMARY OF THE INVENTION

It is the primary object of the present invention to provide an improved memo clip which may clip more paper.

It is another object of the present invention to provide an improved memo clip which is easy to draw a piece of paper out and leave the other paper stay steadly in position.

It is still another object of the present invention to provide an improved memo clip which can be manufactured with any shape or looking as an ornament.

It is still another object of the present invention to provide an improved memo clip which can be made into any shape or any figures as an indoor ornament and still possesses its function.

It is a further object of the present invention to provide an improved memo clip which easy to operate.

It is still a further object of the present invention to provide an improved memo clip which is inexpensive to produce.

BRIEF DESCRIPTION OF THE DRAWINGS

Figure 1:
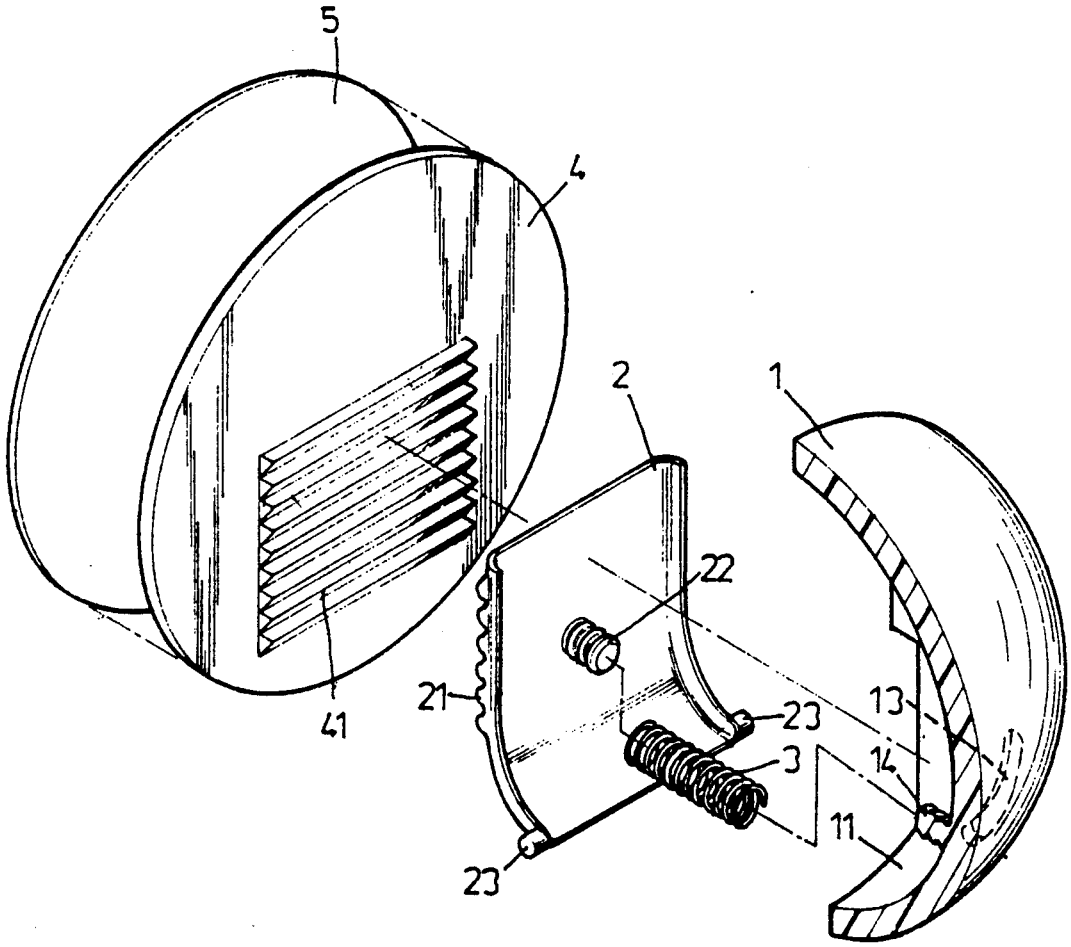
FIG. 1 is a break down view of the present invention.

Reference is now made to the drawings and in perticular to FIG. 1 thereof, a break down view of the present invention. The present invention comprises a main body 1, a pressing plate 2, a spring 3, a back plate 4 and a double adhesive 5. The main body 1, may be made into any shape or figures for attraction purpose, has a concavity 11 at its inner bottom, two grooves 12 at two sides, two notches 13 at two sides and a bolt 14. The pressing plate 2 has several obtuse teeth 21 at its outer side, a bolt 22 at inner side and two lugs 23 at its two lower ends. The back plate 4 is made the same shape like and connected with the main body 1, and has a plate 41 with several of saw teeth.

Figure 2:
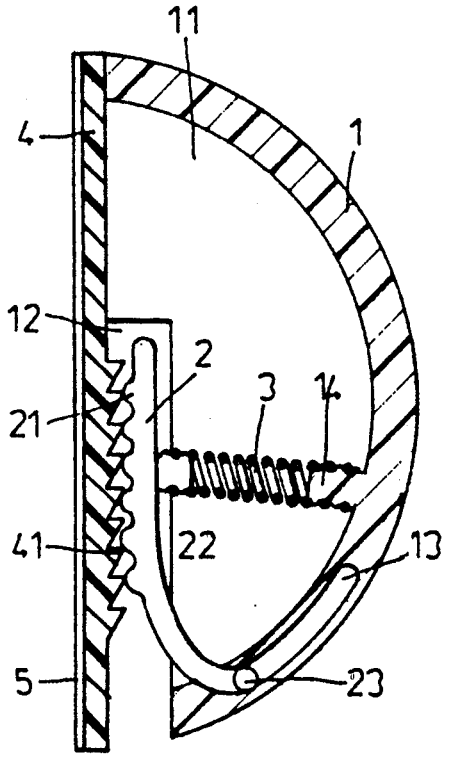
FIG. 2 is a cross-sectional view of the present invention.

The FIG. 2 is a cross-sectional view of the present invention which shows that the main body 1 and the back body 4 have almost one third $\frac{1}{3}$ of the top portion connected with the rest two third $\frac{2}{3}$ bottom portion separated. The pressing plate 2 has the two lugs 23 are placed in the two notches 13 of the main body 1 so that the two lugs 23 can slide in the notches 13 freely. The bolt 22 of the pressing plate 2 has connected with one end of the spring 3 which has its other end firmly connected with the bolt 14 so that the elastic force of the spring 3 will push the pressing plate 2 against the back plate 4.

Figure 3:
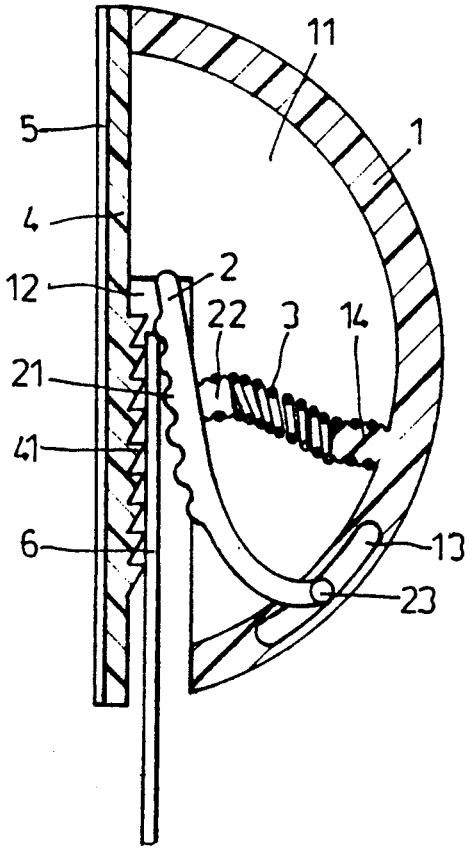
FIG. 3 is another cross-sectional view of the present invention.
Figure 4:
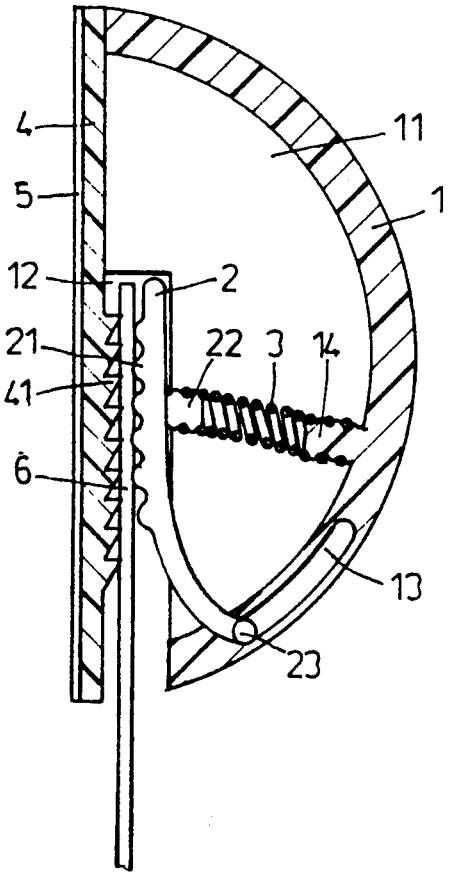
FIG. 4 is still another cross-sectional view of the present invention.

When a deck of paper is inserted into the clip (shown as in FIG. 3), the paper will first push the lower end of the pressing plate 2 which means that the two lugs 23 will slide upward to give more space to the paper and the spring 3, because its two end separately connected with bolts 22 and 14, will be squeezed so that paper can be inserted to the clip (shown in FIG. 4). The saw teeth plate 41 and the obtuse teeth 21 of the pressing plate 2 can hold the paper firmly and if one paper is desired to pull out, simply pull the piece of paper out either right of left hand side notches 13 of the main body 1 and the piece of paper may be easily drawn out without bothering other paper.

Figure 5:
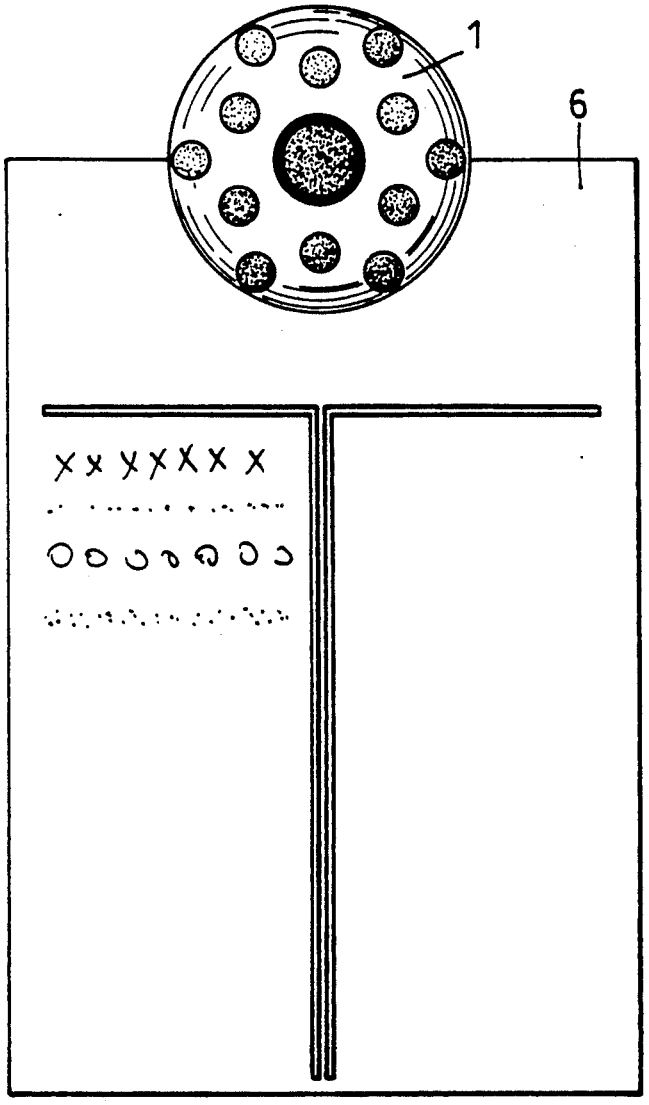
FIG. 5 is a perspective view of the present invention.

FIG. 5 is a perspective view of the present invention which shows that the present invention can be made into any shape or any figures as to attract people's attention.

I claim:

1. An improved memo clip comprising:

a main body having a concavity at its inner bottom, two grooves at two sides, two notches at two sides and a bolt at its concavity;

a pressing plate having several obtuse teeth on top portion, a bolt at its back and two lugs at its two bottom ends;

a back plate having a saw teeth plate;

a spring; and is characteristized by said spring has one end connected with said bolt of said pressing plate and the other end with said bolt of said main body to push said pressing plate against said back plate; and said two lugs placed in said two notches of said main body so that when paper is sticked into said memo clip, said two lugs will be forced to slide backward and said spring will be forced to squeeze to let paper in and stay firmly.

2. An improved memo clip, claimed as in claim 1, wherein said two grooves of said main body are for drawing one piece of paper out and leave the other paper stay still in said clip.

* * * * *